US007433613B2

(12) United States Patent
Zollner et al.

(10) Patent No.: US 7,433,613 B2
(45) Date of Patent: Oct. 7, 2008

(54) METHOD AND DEVICE FOR SETTING THE TONER CONCENTRATION IN THE DEVELOPER STATION OF AN ELECTROPHOTOGRAPHIC PRINTER OR COPIER

(75) Inventors: Alfred Zollner, Eitting (DE); Bernhard Hochwind, München (DE); Wolfgang Schullerus, Raubling (DE); Volkhard Maess, Pliening (DE); Hans-Detlef Groeger, Poing (DE); Peter Möstl, Altdorf (DE)

(73) Assignee: Oce Printing Systems GmbH, Poing (DE)

( * ) Notice: Subject to any disclaimer, the term of this patent is extended or adjusted under 35 U.S.C. 154(b) by 116 days.

(21) Appl. No.: 10/520,187

(22) PCT Filed: Jul. 23, 2003

(86) PCT No.: PCT/EP03/08056

§ 371 (c)(1),
(2), (4) Date: Jul. 31, 2006

(87) PCT Pub. No.: WO2004/012015

PCT Pub. Date: Feb. 5, 2004

(65) Prior Publication Data

US 2006/0269303 A1 Nov. 30, 2006

(30) Foreign Application Priority Data

Jul. 24, 2002 (DE) ..... 102 33 671

(51) Int. Cl.
*G03G 15/08* (2006.01)
*G03G 15/10* (2006.01)

(52) U.S. Cl. ..... 399/30; 399/58

(58) Field of Classification Search ..... 399/30, 399/58, 59, 61, 62
See application file for complete search history.

(56) References Cited

U.S. PATENT DOCUMENTS

| | | | | |
|---|---|---|---|---|
| 5,202,769 | A * | 4/1993 | Suzuki | 399/58 X |
| 5,353,102 | A | 10/1994 | Sato et al. | |
| 5,724,627 | A | 3/1998 | Okuno et al. | |
| 5,839,022 | A * | 11/1998 | Wang et al. | 399/62 |
| 5,974,279 | A * | 10/1999 | Slabbaert et al. | 399/61 |
| 6,173,134 | B1 | 1/2001 | Nishimura et al. | |
| 6,404,997 | B1 | 6/2002 | Grace | |

FOREIGN PATENT DOCUMENTS

| | | |
|---|---|---|
| DE | 196 31 261 | 2/1997 |

(Continued)

*Primary Examiner*—Sandra L Brase
(74) *Attorney, Agent, or Firm*—Schiff Hardin LLP

(57) ABSTRACT

In a method and system for setting toner concentration of a toner particle-carrier particle mixture in a developer station for development of a latent charge image on a carrier, a sensor is arranged in the developer station measuring the toner concentration. Toner feed in the developer station is adjusted. A current consumption value is determined for toner particles. From the toner concentration measured with the sensor and from the toner consumption value, a toner concentration is calculated at a location in the developer station at which the toner is extracted. A calculated toner concentration at the toner extraction location is input as a control variable used to adjust toner feed so that the calculated toner concentration approaches a desired value.

33 Claims, 13 Drawing Sheets

FOREIGN PATENT DOCUMENTS

| | | |
|---|---|---|
| DE | 199 00 164 | 7/2000 |
| DE | 41 37 708 | 6/2001 |
| DE | 101 36 259 | 2/2003 |
| JP | 01187580 | 7/1989 |
| JP | 03045973 | 2/1991 |

* cited by examiner

METHOD AND DEVICE FOR SETTING THE TONER CONCENTRATION IN THE DEVELOPER STATION OF AN ELECTROPHOTOGRAPHIC PRINTER OR COPIER

BACKGROUND

The present disclosure concerns a method and a device to set the toner concentration of a toner particle-carrier particle mixture in a developer station of a printer or copier, as well as a device to develop a latent charge image on an intermediate carrier of an electrophotographic printer or copier.

The toner particles, also sometimes called "toner" for short in the following, serve for inking of the latent charge image on the intermediate carrier. The toner is then transferred from the intermediate carrier onto a recording medium, for example paper, in a further step.

For example, as carrier particles, small iron or steel granules are known. These typically have a two-fold function: on the one hand, the toner particles triboelectrically charge given blending of the mixture with the carrier particles; on the other hand, the toner particles attach to the carrier particles and, bonded to these, are conveyed to the intermediate carrier. The transport of the carrier particles to the intermediate carrier is thereby, for example, accomplished with a magnetic developer roller to which the toner particles attach. In the immediate proximity of the intermediate carrier, the electrically-charged toner particles correspondingly transfer the electrical field of the charge image to the intermediate carrier, while the toner particles remain in the developer station or are carried back to the developer station.

During the development, toner is thus removed from the developer station which must be replaced by a corresponding toner feed into the developer station. It is thereby necessary, both for the quality of the print image and for the interruption-free operation of the developer station, that the toner concentration always corresponds to a predetermined value, called a desired value in the following.

To set the toner concentration to this desired value, regulation methods are typically used in which the current toner concentration, i.e. the actual value (or a quantity dependent on this) is measured and its difference from the desired value (what is known as the regulation deviation) is minimized via suitable adjustment of a correcting variable, for example the toner feed.

To measure the toner concentration in the developer station, for example, the magnetic permeability of the mixture (which is characteristic for the toner concentration since only the carrier particles are magnetizable) can be measured with the aid of a sensor.

However, for space reasons such a sensor cannot be arranged in the section of the developer station from which the toner is actually removed for development of the charge image, as is explained in detail below using an exemplary embodiment. Instead of this, the sensor must be accommodated in what is known as the reservoir of the developer station. This is problematic since, in the print or copy operation, a toner concentration decline appears within the developer station such that the toner concentration measured in the reservoir deviates from the toner concentration in the toner extraction region relevant for the printing process. Thus the regulation is based on a falsified real value. A further problem is that the sensor measurement value is influenced by the current toner charge, which changes dependent upon, among other things, the toner flow rate. The real value forming the basis can also thereby be thus falsified.

These problems are bypassed in conventional methods in that, instead of a direct measurement of the toner concentration, a toner marking is generated on the intermediate carrier and then is scanned with a reflex light sensor or the like. A print density can thereby be determined that in turn is characteristic of the toner concentration.

This method is, for example, described in DE 101 36 259. In this, a toner marking is generated on a photoconductor, whereby this is exposed with an intensity at which the print density varies particularly significantly with the toner concentration. The toner concentration can thereby in principle be very precisely determined, especially as the concentration of the toner in a section of the developer station from which the toner has been extracted is thus actually detected.

However, the toner concentration measurement with the aid of a toner marking is indirect, inasmuch as the print density of the toner marking is still dependent on, aside from the toner concentration, a series of further quantities. Belonging to these quantities are, for example, the exposure intensity of a character generator, the degree of the electrostatic charge of the toner, the intensity of the charge of the intermediate carrier and the magnitude of the voltage between developer roller and intermediate carrier. The toner concentration can only then be reliably determined from the toner marking when all of these quantities assume a known, constant value.

However, when one or more of these quantities change without being noticed, for example as a result of a defect in the device, a false real value is supplied to the controller of the concentration regulation. This can, for example, lead to toner being continuously supplied to the developer station until this clogs, or to no toner at all being supplied over a longer period of time and the toner concentration continuously decreasing, whereby it can lead, for example, to a charge arc-over between intermediate carrier and developer roller because the electrical resistance of the mixture decreases with the decrease of the (electrically non-conductive) toner. In both cases, it can lead to severe damage to the developer station. For reasons of operational safety and monitoring capability of the system, a direct concentration measurement is thus preferable.

A further problem in conventional methods for regulation of the toner concentration is that the equalization of the toner concentration to the desired value happens relatively slowly because the regulation amplification must be kept relatively low. A too-high regulation amplification leads to an unstable regulation behavior, an increase of the interference susceptibility and poorer guidance behavior.

DE 199 00 164 A1 shows a method and a device for regulation of the toner concentration in an electrophotographic process. Two operating states are provided therein. In one operating state, a toner marking is generated on the intermediate carrier, the density of the toner marking is scanned and the toner marking is removed again from the intermediate carrier. The scanned toner marking value is used for regulation of the toner concentration in the developer station and, for example, influences a toner concentration desired value or a regulation threshold. In the other operating state, the information to be printed in the intermediate carrier is generated as a toner image and is transfer-printed onto a recording medium. In this other operating state, the toner concentration in the developer station is detected with a toner concentration sensor and it is attempted, via a corresponding return conveyance, to maintain a constant toner concentration in the developer station. As an alternative to regulation of the toner concentration with the aid of the toner concentration sensor, it is proposed to control the toner supply quantity via estimation of the toner consumption value.

DE 196 31 261 A1 shows a device for use in an electrophotographic apparatus, with a first regulation device that determines a desired value for the toner concentration in a developer station using the blackening of test markings and a second regulation device (downstream from the first regulation device) that regulates the toner concentration in the developer station based on this desired value. The second regulation device has a sensor to determine the toner concentration in the developer station and, dependent on the measured toner concentration, generates a toner refilling signal that can be optionally modified by a signal that corresponds to a toner consumption value.

In none of these documents is the problem dealt with that the toner concentration measured at the installation point of the sensor could deviate from the toner concentration at the location of the toner extraction.

Further related prior art is to be learned from the documents DE 41 37 708 C2, U.S. Pat. No. 5,353,102 and JP 03045973 A, JP 3 045 973 and U.S. Pat. No. 6,173,134.

A method to control the image density in an electrophotographic printer or copier is disclosed in U.S. Pat. No. 6,404,997 B1. In this method, the toner concentration at the developer station is calculated from a measured toner concentration and a dynamically programmed delay value. The calculated toner concentration is used to control the electrostatic developing fields.

SUMMARY

It is an object to specify a method and a device that enables a development of a latent image with toner with high print quality.

In a method and system for setting toner concentration of a toner particle—carrier particle mixture in a developer station for development of a latent charge image on a carrier, a sensor is arranged in the developer station measuring the toner concentration. Toner feed in the developer station is adjusted. A current consumption value is determined for toner particles. From the toner concentration measured with the sensor and from the toner consumption value, a toner concentration is calculated at a location in the developer station at which the toner is extracted. A calculated toner concentration at the toner extraction location is input as a control variable used to adjust toner feed so that the calculated toner concentration approaches a desired value.

DESCRIPTION OF THE PREFERRED EMBODIMENTS

Figure 1:
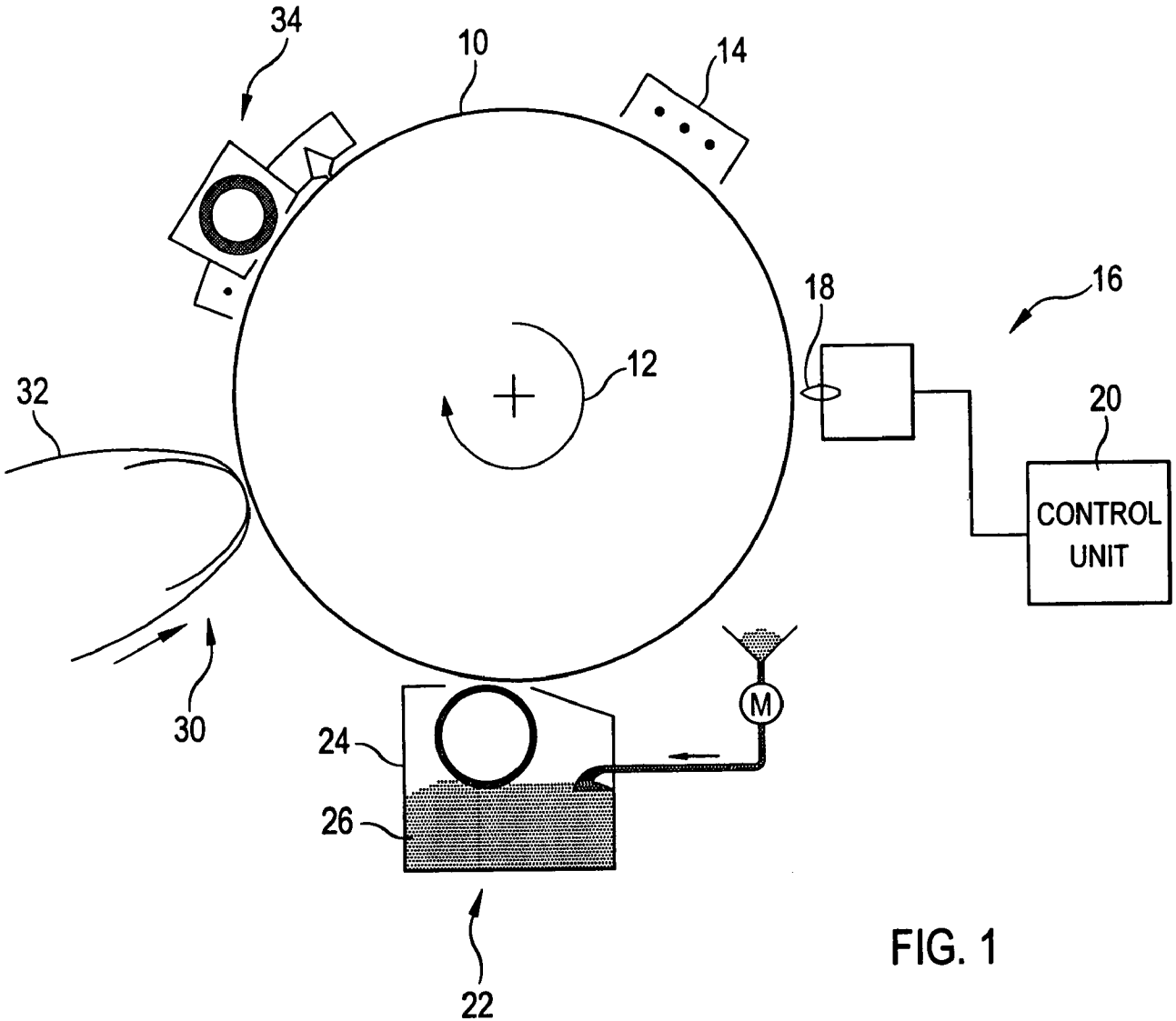
FIG. 1 is a schematic drawing of components of an electrophotographic printer.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In this method, the toner concentration in the mixture is measured with a sensor arranged in the developer station and the toner feed is adjusted with an actuator, whereby a current consumption value for toner particles is determined and a regulation unit for regulation of the toner concentration activates the actuator dependent on the signal of the sensor and on the determined consumption value. The toner concentration in a section of the developer station from which the toner is removed for development of the latent image is thereby calculated from the toner concentration measured at the installation point of the sensor and from the toner consumption value.

The term "determination" of the consumption value is to be understood in a broad sense: what is meant is both a more or less precise measurement and a mere estimation. Examples for suitable estimations of the consumption value are given below.

Using the determined current consumption value, the errors in the direct measurement can be corrected to a certain degree, since both the spatial concentration decline in the developer station and the electrostatic charge of the toner are connected with the current toner consumption. In particular, the calculated toner concentration at the toner removal location can be input in the regulation unit as a control variable and the actuator can be activated by the regulation unit such that the calculated toner concentration at the toner removal location is approximately a desired value.

The current toner consumption value can also be directly considered in the regulation of the toner concentration, and not only when it manifests in a regulation deviation. The dynamic behavior of the regulation is thereby improved.

In the method, the actuator is preferably controlled by the combination of a first and a second manipulating variable, whereby the first manipulating variable is proportioned according to the toner consumption value and the second manipulating variable is proportioned according to the measured toner concentration. The first manipulating variable is thereby preferably measured such that it effects a toner feed that corresponds to the current toner consumption value. In this case, the current consumption value thus virtually represents a disturbance variable that counteracts the first manipulating variable directly and without feedback. The second manipulating variable is preferably measured such that it regulates the toner concentration to a desired value.

In the simplest case, the cited "combination" of both manipulating variables is simply an addition of the two. For example, the first manipulating variable can be the output signal of a control chain that is added to the signal of the second manipulating variable which is in turn formed by the output signal of a control loop. However, it is equally as conceivable that the consumption value is converted into an auxiliary variable that is fed into the controller and is measured such that it produces a manipulating variable that corresponds to a toner feed according to the consumption value. When a regulation deviation and this auxiliary variable are now simultaneously fed into the controller, the controller outputs a manipulating variable that here is designated as a "combination" of the two manipulating variables, namely a first manipulating variable that resulted when only the auxiliary variable was fed into the controller and a second manipulating variable that resulted when only the regulation deviation was fed into the controller. Depending on the type of the controller, this combination of the first and second manipulating variables is not necessarily a sum but a function of the two. In the present invention the term of the "combination" of both manipulating variables should be understood by this generality.

In an advantageous embodiment of the method, the toner feed adjusted at the actuator is assumed as a toner consumption value. This selection of the estimated value results from the following consideration: when the method operates as desired, the current toner concentration corresponds to its desired value and the current toner feed corresponds to the current toner consumption. In this case, the current toner feed is thus a very good estimate for the current toner consumption. The selection of the estimated value is internally consistent: the better the method works, the better the estimate of the toner consumption, based on which the method then works better in turn. It has been shown that, in spite of the implicit feedback due to suitable selection of regulation parameters, a very stable regulation behavior can be obtained. The advantage of this special execution of the method is that the current toner feed is a quantity that is simple to detect, such that this method can be used without large structural interferences in conventional devices.

In a particularly advantageous development of the method, the toner consumption value is estimated from the print data. The toner consumption value is preferably estimated from the number of pixels to be printed, weighted with their inking level. Such an estimation of the toner consumption value is already known from U.S. Pat. No. 5,202,769, where, however, it is only used for pure control of the toner feed but not in the framework of a regulation. A mere control is, however, unsuitable to adjust the toner concentration in a stable and safe manner over a long period of time because small, systematic deviations between actual and estimated toner consumption add up with time. Given interferences in the printing or copying process, the deviation of actual and estimated toner consumption can become very large, such that a much-too-high or much-too-low toner concentration suddenly appears in the developer station that can lead to damaging it, as mentioned above.

The estimation of the toner consumption value from the print data can in practice be precisely implemented, such that the first manipulating variable measured on the toner consumption value already effects a toner concentration in the developer station that is near to the desired value for short and medium spans of time. The second manipulating variable then effects only a relatively small correction of the toner feed pre-controlled by the first manipulating variable. Overall, a significantly improved regulation dynamic thereby results because the pre-controlled portion of the toner feed (thus the first manipulating variable) reacts immediately to the determined toner consumption value and the second manipulating variable has to compensate for far lesser regulation deviations than in a conventional method.

Since the print data are processed in a control unit in a printer or copier, these must be modified for implementation of the last-cited method in conventional devices. When this should be prevented, for example for cost reasons or for preservation of the continuity of a product palette, in an alternative development of the method the toner consumption value can be estimated from the number of the pixels (weighted with their inking level) that are set in the character generator generating the latent print image. The pixels are thereby counted with the aid of an application-specific integrated circuit that is connected with the character generator. This solution thus requires only a relatively small expansion but not a significant modification of a conventional printer or copier system.

In a further alternative development, the toner consumption value is estimated using the current consumption of the character generator generating the latent charge image. This is possible because the toner consumption and the current consumption in the character generator are directly connected. To generate each image point of the charge image, a certain light energy is necessary that is in turn reflected in the current consumption of the character generator. In practice, a toner consumption value can be estimated that is sufficiently good for the purposes of the method. The advantage of this developed method is that it can be implemented with minimal structural expansions in existing printer or copier systems.

In the framework of the described method, for practical reasons the toner consumption value can be "anticipatorily" determined. This is, for example, the case in the development cited above, in which the consumption value is estimated from print data that typically already exist a certain time before the development of the charge image. In such a case, the determined toner consumption value is preferably stored in a data buffer, for example a delay buffer, until inking of the corresponding print image. To regulate the toner concentration, dependent on the determined consumption value the regulation unit then activates the actuator at exactly the point in time at which the determined consumption actually occurs, whereby the regulation dynamic improves.

In an advantageous development, the relative weighting of the first and second manipulating variables varies in the course of the print or copy process. The second manipulating variable is thereby suppressed in the start phase of a print or copy process, and its weighting is increased when the state of the mixture in the developer station has stabilized. In the start phase, the toner concentration in the developer station can be only imprecisely determined since the mixture flow has not yet stabilized. Due to the imprecise concentration measurement in the start phase, it is thus provided to initially forego the first manipulating variable.

The controller unit preferably comprises a PID controller. In an advantageous embodiment, the regulation parameters used in the course of the print or copy process are varied.

In the following, the main features of the electrophotographic printer or copier are explained briefly with reference to FIG. 1. Shown in cross-section in FIG. 1 is a photoconductor drum 10 whose peripheral surface is coated with a photosemiconductor, for example arsenic triselenide ($As_2Se_3$). Such a photosemiconductor has a high dark resistance that, however, decreases given sufficient exposure. The photoconductor drum 10 rotates in the direction indicated with the arrow 12. Its photosemiconductor is thereby initially electrostatically charged with the aid of what is known as a charge corotron 14. Via rotation of the photoconductor drum 12, the charged section arrives at a character generator 16 with a light source 18 (and LED comb in FIG. 1) and a control unit 20. The control unit 20 provides at which points the photoconductor drum 10 should be exposed. The electrical resistance of the photosemiconductor drops at the coated locations and the charge discharges. Image points of a latent charge image are thus generated on the photoconductor drum. These image points, called pixels, are thus "set" in the character generator.

Given a further rotation of the photoconductor drum 10, the latent charge image arrives at a developer unit 22. The developer unit 22 comprises a reservoir 24 in which a mixture 26 made up of toner particles and carrier particles is located. In the illustrated developer station, the carrier particles are made up of a magnetic material such as iron or steel and ferrite. The carrier particles can be attracted by a magnetic developer roller 28 and be conveyed to the photoconductor drum 10 (together with the toner particles adhering to them) via rotation of the developer roller 28. The carrier particles thereby align along the magnetic field lines generated by the developer roller 28, such that they form a brush-like arrangement on the surface of the developer roller 28, which are designated as a "magnet brush" 56 (compare FIG. 4).

The toner particles are triboelectrically charged in the developer station 22 and transferred from the magnet brush 56 to the exposed (what is called "dark-writing") or unexposed points of the photosemiconductor (what is known as light-writing). The charge image located on the photoconductor drum is thus inked with toner, i.e. developed.

The toner image is then transferred to a transfer printing station 30 on a print substrate, for example a sheet of paper 32. The photoconductor drum 10 is therefore generally designated as an intermediate carrier.

Given the transfer printing, toner remaining on the photoconductor drum 10 is ultimately removed with the aid of a cleaning device 34.

Figure 2:
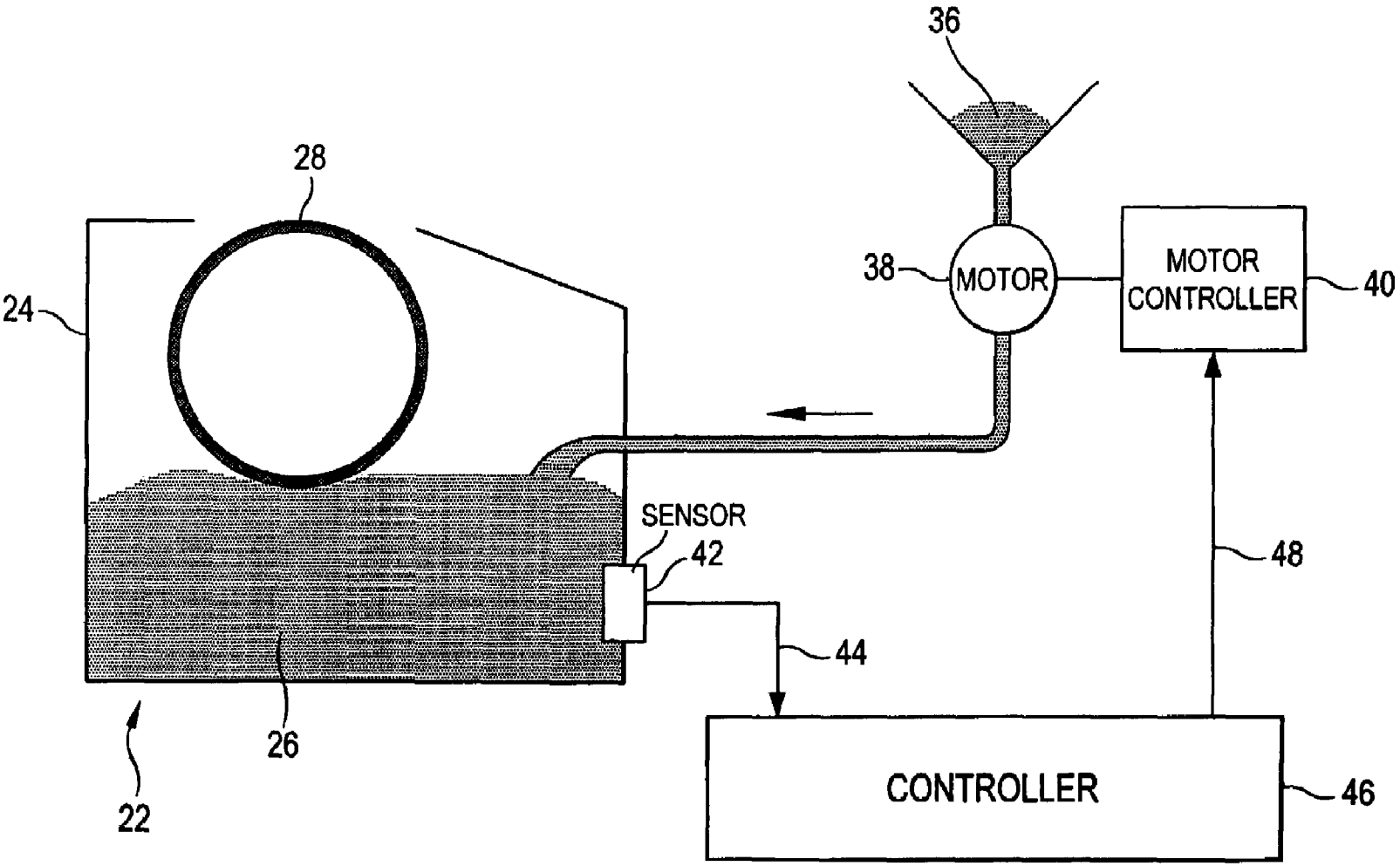
FIG. 2 is a schematic representation of a developer station with toner feed and regulation unit.

The developer station 22 is shown enlarged in FIG. 2. Since, in the development of the latent charge image, only toner is transferred onto the photosemiconductor layer but not carrier particles, the toner concentration in the reservoir 24 of the developer station 22 would decrease with time if non-flowing toner were supplied into the developer station 22. The developer station 22 is therefore connected with a toner reservoir 36 and the toner feed from the reservoir 36 into the developer station 22 occurs with the aid of a motor 38 that drives a conveying device.

The conveying capacity of the motor 38 is predetermined by a motor controller 40. A typical method to set the toner concentration in the developer station 22 is based on a simple control loop. The current toner concentration in the developer station 22 is thereby measured with the aid of a sensor 42. The measured toner concentration is the control variable 44, which represents the input signal in a controller 46. In the controller 46, the regulation deviation is calculated via subtraction of the control variable 44 from a command variable. The control variable is called a real value, and the command variable is called a desired value. From the regulation deviation, the controller 46 generates a manipulating variable 48 that is sent to an actuator that, in the present case, is formed by the motor 38 and the motor controller 40. The manipulating variable 48 is proportioned such that, via motor controller 40 and motor 38, it effects a toner feed that compensates the regulation deviation. It is noted that here and in the following terms such as control variable 44 and manipulating variable 40 are used both for the abstract elements of the control loop and for the signals that convey the corresponding variables.

Figure 3:
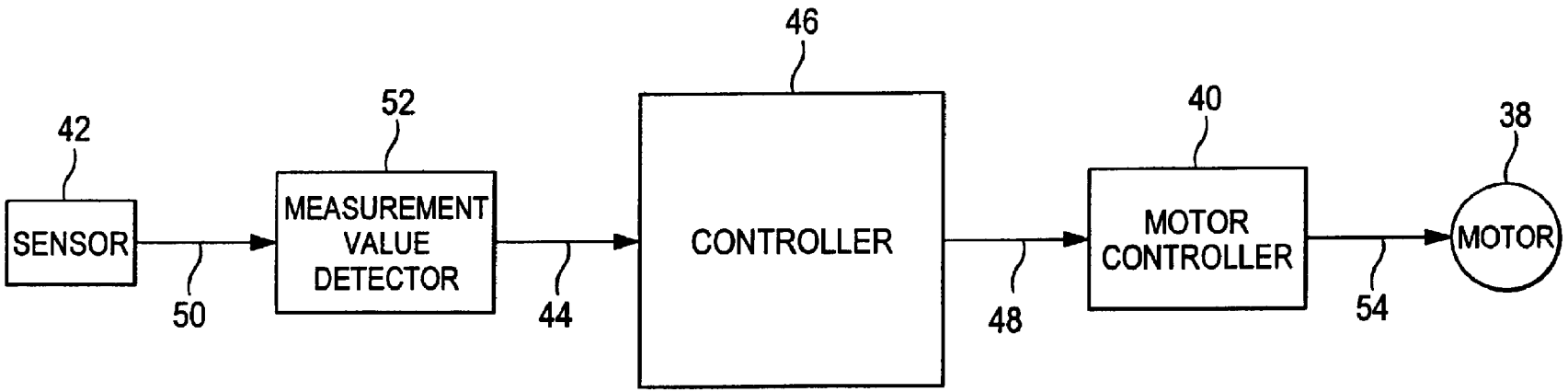
FIG. 3 (PRIOR ART)
FIG. 3 is a block diagram in which a conventional regulation method is shown.

The significant elements of this conventional regulation method are comprised in a block diagram in FIG. 3. Via the elements and signals moreover discussed in connection with FIG. 2, in FIG. 3 a measurement value detection device 52 is shown that, based on a sensor signal 50 of the sensor 42, generates the control variable 44 and a motor signal 54 with which the motor controller 44 activates the motor 38. The motor can be intermittently operated or varied in terms of the rotation speed.

Figure 4:
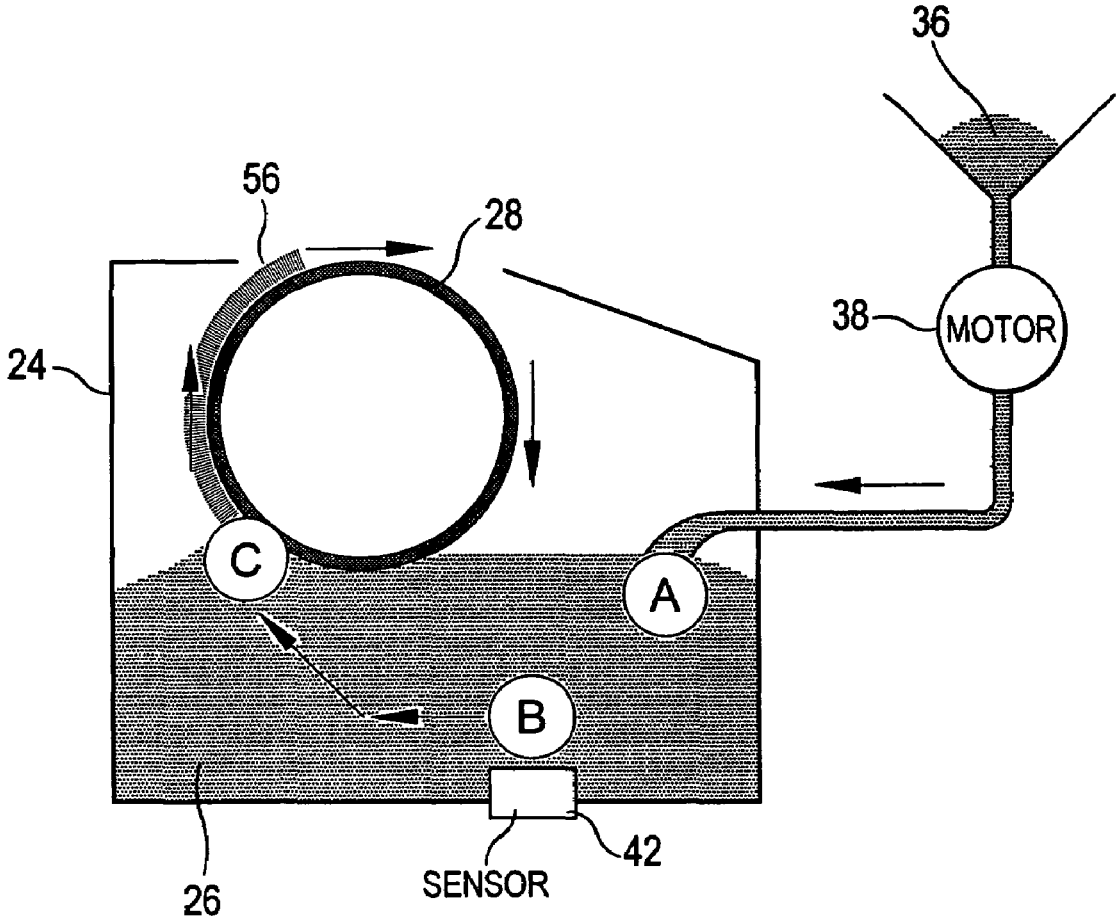
FIG. 4 is a schematic representation of a developer station in which the spatial dependence of the toner concentration is shown in an exemplary fashion.

This conventional regulation method shown in FIG. 3 is, however, afflicted with a plurality of problems. The first problem is that the toner concentration measured with the aid of the sensor 42 does not necessarily coincide with the toner concentration at the location at which the toner is actually extracted for development of the photoconductor 10. The problem is schematically shown in FIG. 4, in which the brightness of the toner-carrier particle mixture 26 exemplarily represents the toner concentration. The toner concentration is particularly high in the region designated with A, in which toner is supplied, and is particularly low in the region designated with C, from which toner is extracted for development. This toner concentration decline occurs although the mixture 26 in the developer station is, for example, mixed with the aid of a paddlewheel (not shown). The term "decline" should not thereby express that the toner concentration changes linearly with the location. In reality, a general, non-linear relation can exist between toner concentration and location.

The concentration significant for the print or copy process is that in the toner extraction region C. In the toner extraction region C, however, no sensor can be installed because this would be in the way of the developer roller 28 and the formation of the magnet brush 56. Instead of this, the sensor must be arranged at a location B in the reservoir 24 of the developer unit 22, at which the current toner concentration for the most part does not coincide with that in the toner extraction region C.

Figure 5:
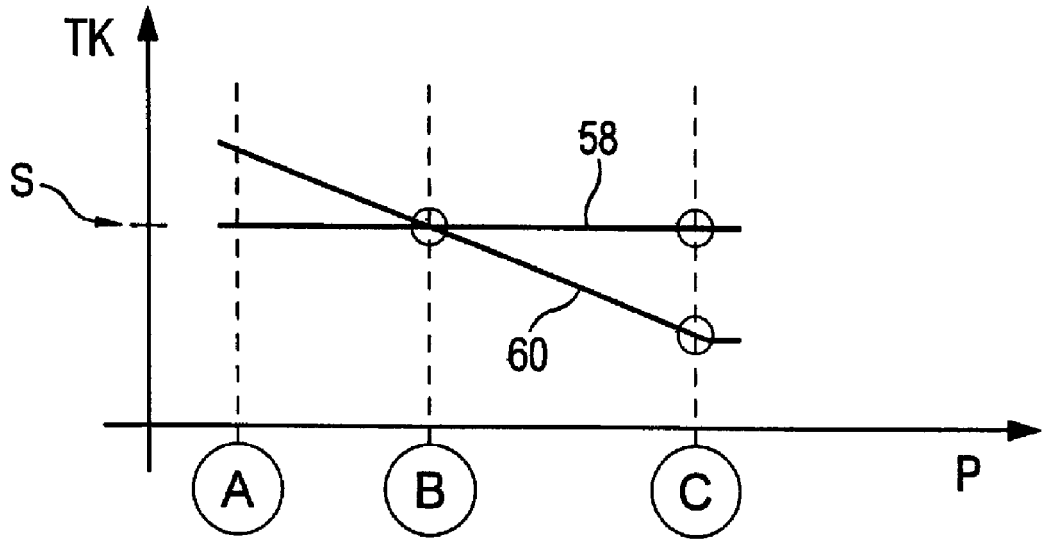
FIG. 5 (PRIOR ART)
FIG. 5 is a schematic diagram of the toner concentration distribution in a developer station given a conventional regulation method.

The toner concentration decline is shown in the diagram of FIG. 5. The graph 58 therein shows the toner concentration (TK) (dependent on the position P) in the developer station 22 given low toner consumption, i.e. less toner extraction per time unit. As is to be seen in FIG. 5, the toner concentration in the entire developer station is thereby nearly identical. This is because, given low toner consumption, sufficient time exists to equalize the toner concentration via mixing of the toner-carrier particle mixture.

The graph 60 shows the spatial toner concentration distribution given high toner consumption. Given high toner consumption, in fact (as is to be seen in FIG. 5), a considerable toner concentration decline arises within the developer station 22. When, as shown in FIG. 5, the toner concentration is regulated to its desired value (S) at the installation point B of the sensor, the toner concentration in the extraction region C lies well below the desired value. This leads to poor printing behavior and, in the worst case, to damage to the developer station 22. FIG. 5 is to be understood as only schematic. For purposes of simplicity a linear curve of the toner concentration dependent on the position is assumed, but a more complicated dependency is also possible.

Since the gradient of the toner concentration in the developer station 22 depends on the current toner consumption, the method more or less precisely determines a current toner consumption value, and from this, together with the toner concentration measured at the installation point B of the sensor, calculates the toner concentration in the extraction region C. The toner concentration at the installation point B of the sensor is then adjusted such that the (calculated) toner concentration in the extraction region C corresponds to the desired value.

Figure 6:
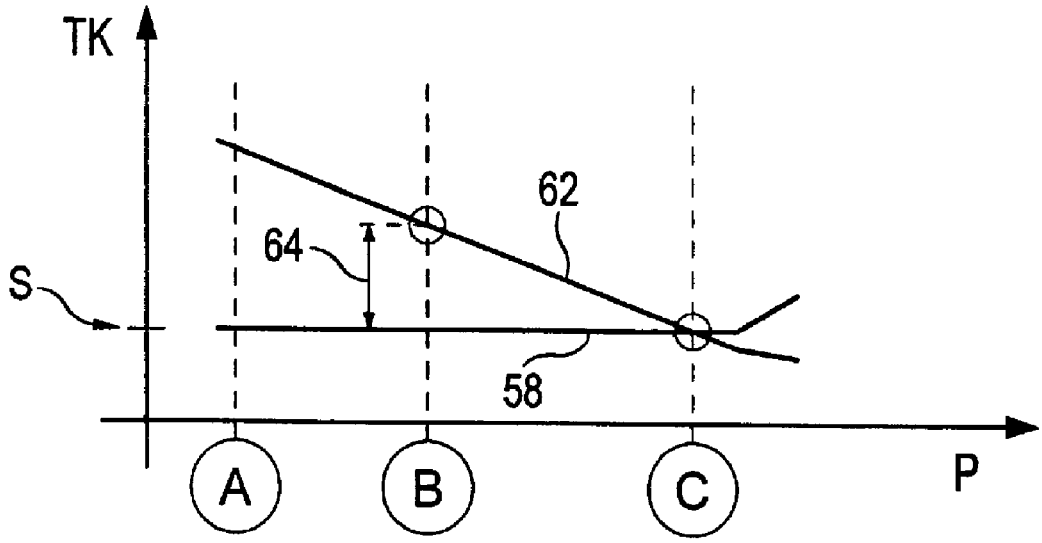
FIG. 6 is a schematic diagram of the toner concentration distribution in a developer station given the inventive regulation method.

The toner concentration distribution thus effected is shown as a graph 62 in FIG. 6. The difference between actual toner concentration set at the location B and the desired value (S) is called sensor correction 64. The sensor correction 64 is, as indicated, a variable that is calculated from the determined toner consumption value.

The "calculation" of the toner concentration in the extraction region C typically occurs via a simulation. The simulation is thereby based on a model for the correlation between the toner concentration at the extraction location C, the toner concentration at the location B of the sensor 42 and the toner consumption value. The model and its model parameters can be empirically determined via adaptation to test measurements.

In tests, the inventor has discovered that the toner concentration TK(C) at the extraction location C can already be very precisely simulated from the toner concentration at the installation point of the sensor TK(B) and the toner consumption value with a simple, linear model, as follows:

$$TK(C)=TK(B)-\alpha\cdot\text{toner consumption value.}$$

$\alpha$ is thereby an empirically determined proportionality constant. This simulation model can, for example, be expanded by terms in higher order in the toner consumption value whose coefficients can be determined via adaptation to experimentally determined data.

In the following, a plurality of possibilities are proposed to determine the current toner consumption value. It is clear that "determine" in this context cannot mean exact detection of the actual current toner consumption, because if this were possible the object of the method would already be achieved. In the framework of the present disclosure, "determine" means any direct or indirect approximative determination of the current toner consumption, including its estimation.

Figure 7:
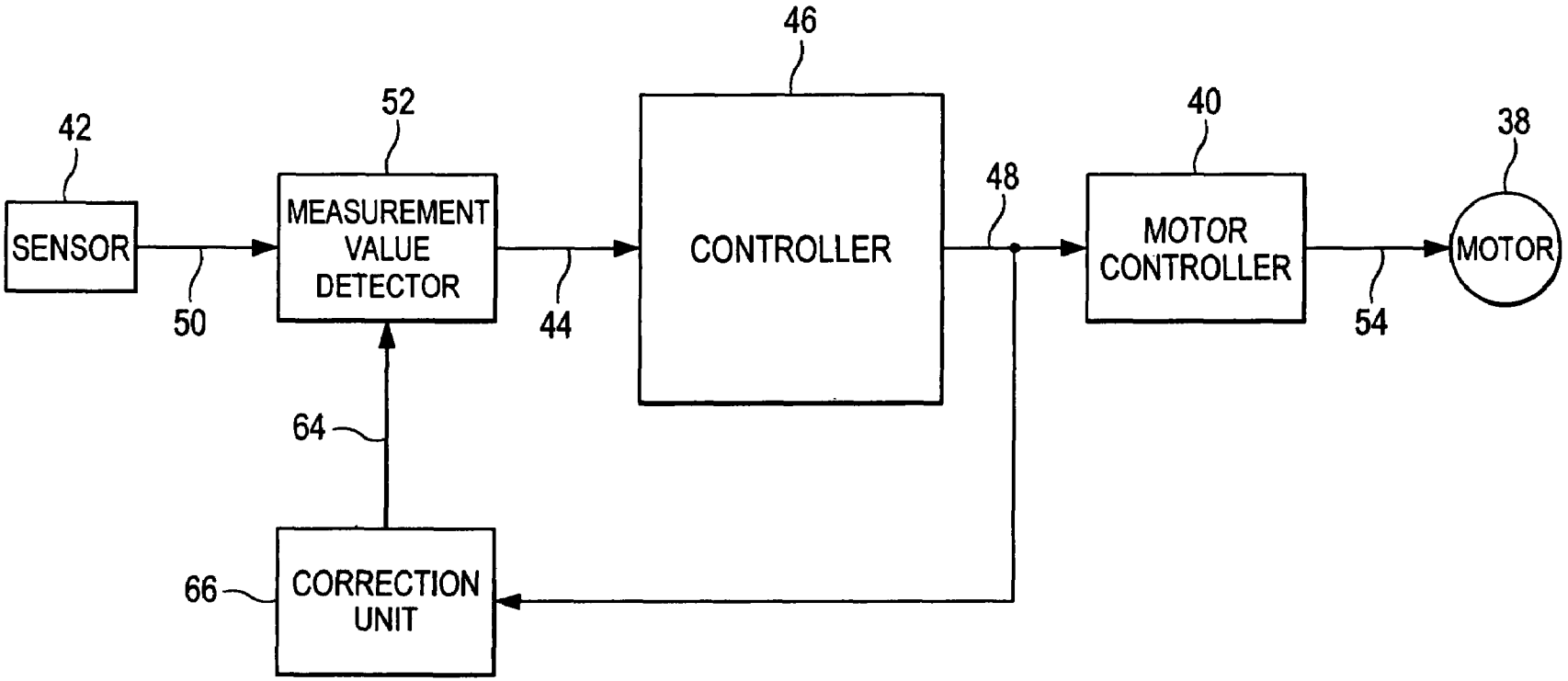
FIGS. 7 through 9 are block diagrams of three embodiments of the method.

Given a steady-state control loop, the manipulating variable 48 is already a relatively good estimated value for the current toner consumption. As shown in FIG. 7, in one execution of the method the manipulating variable 48 is therefore input as a current toner consumption value into a correction unit 66, which from this determines the sensor correction 64 and which sends a corresponding sensor correction signal to the measurement device 52. Again, in the following differentiation is made neither linguistically nor with regard to the reference character between the sensor correction and the corresponding signal.

The use of the manipulating variable 48 as a toner consumption value represents a feedback that could, in principle, bring the control loop out of equilibrium. However, in practice it has been shown that a stable regulation behavior can be achieved with this feedback given suitable selection of the regulation parameters.

Figure 8:
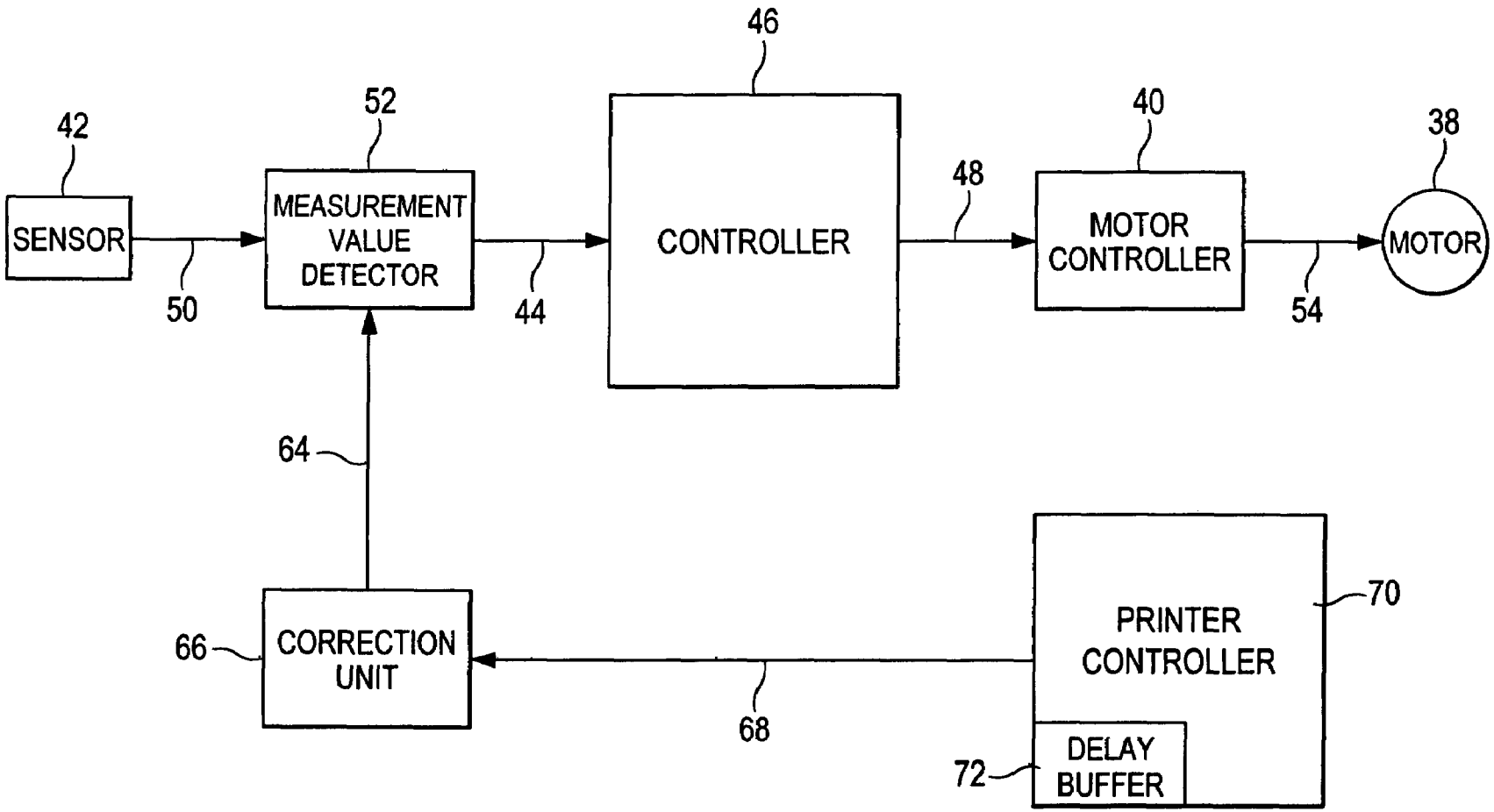

In another execution of the method shown in FIG. 8, the toner consumption value 68 is determined in a printer controller 70 using print data and transmitted to the correction unit 66. The consumption value 68 can be calculated in the printer controller during or after the preparation of the print data. In the shown exemplary embodiment of the method, the number of pixels to be inked is determined from the print image data for each of a certain number of inking levels, and from this number of pixels to be inked the toner consumption is estimated. This occurs precisely as follows: one of m inking levels (grey levels) is associated with each of the pixels to be printed, whereby m is a natural number. When the number of pixels of the i-th inking level is designated with $n_i$, the estimated value for the toner consumption is calculated according to:

$$\text{toner consumption}=k_{consumpton}\cdot(k_1\cdot n_1+\ldots+k_i\cdot n_i+\ldots+k_m\cdot n_m)+k_0,$$

whereby $k_i$ is the weighting factor of the pixel number of the i-th inking level and $k_{consumption}$ is a proportional factor. $k_0$ designates a base consumption of toner via dust formation, suction, etc.

The print image data are prepared before the exposure and inking of the photosemiconductor of the photo drum 10 in the printer controller 70. A certain not-insignificant time span can exist between the preparation of the print data and the development of the photoconductor. In the representation of FIG. 8, a delay buffer 72 is therefore provided in which the toner consumption value determined by the printer controller 70 is cached for the duration of this time span, and is only forwarded to the correction unit 66 when the image corresponding to the print data is actually developed.

In addition to the inhomogeneous toner concentration distribution in the developer station 22 described above, there is a further error source that can falsify the concentration measurement. The measurement value of the sensor 42 is influenced by the size electrostatic charge of the toner, which is in turn subject to fluctuations. However, the charge state of the toner is likewise dependent on the toner flow rate, i.e. the toner consumption. A falsified measurement value based on a toner charge deviating from the desired value can therefore likewise be corrected by the correction unit 66 using the current toner consumption value 68.

A further problem of the regulation method of FIG. 3 and also of the improved regulation method of FIGS. 7 and 8 is that the regulation dynamic that can be therewith achieved is relatively sluggish. This means, for example, that only a certain toner deficiency first has to arise before the controller 46 begins, via motor controller 40 and motor 38, to supply the lacking quantity of toner. The reason for this is that the regulation amplification of the controller 46 cannot be selected arbitrarily large because otherwise the control loop is incident-prone. As a consequence, given a conventional regulation method again and again a toner concentration in the developer station 22 occurs that significantly deviates from the desired value, which impairs the print quality and, in the worst case, can lead to damage to the developer station 22.

Figure 9:
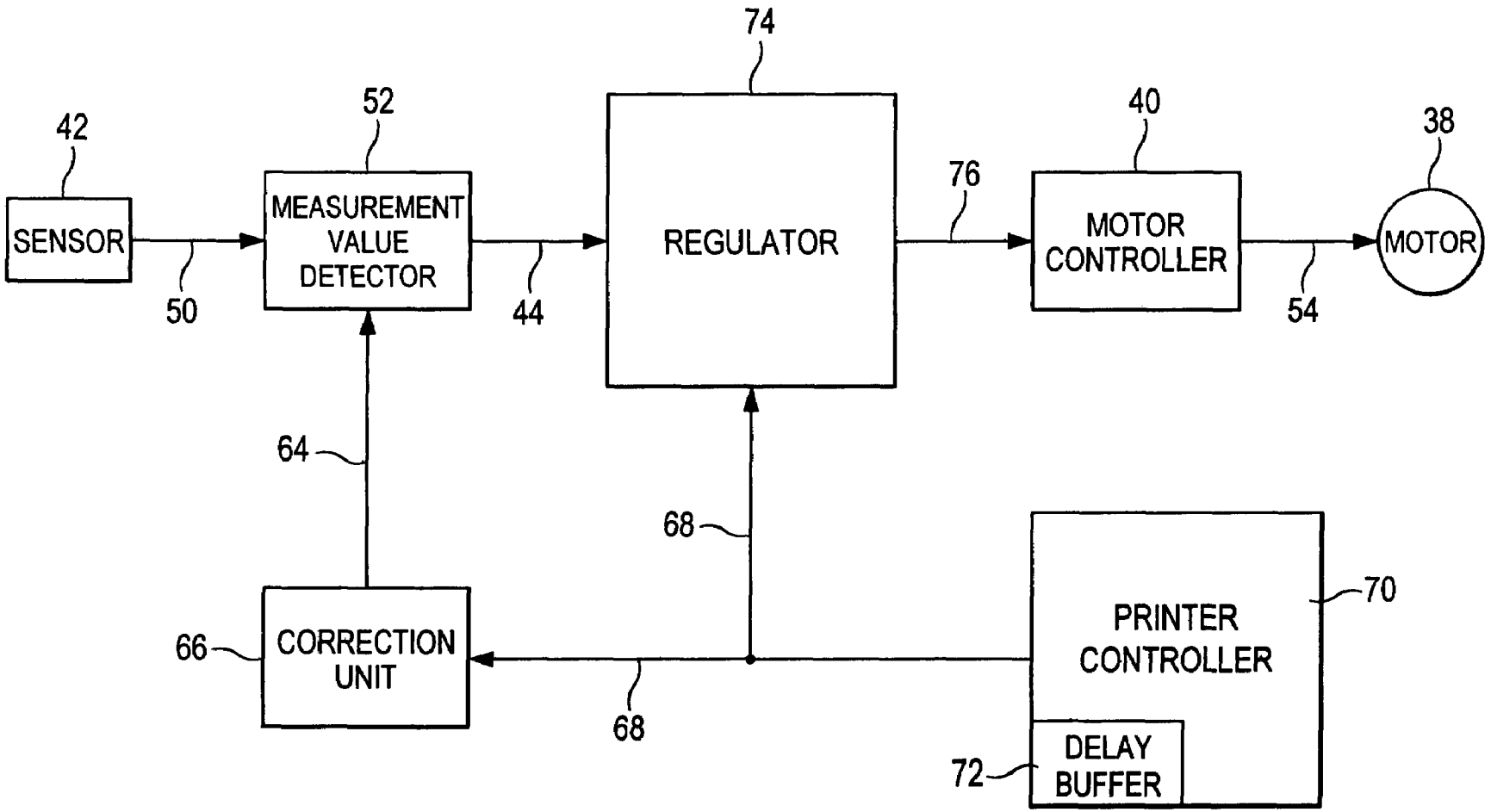

A solution for this problem is shown in FIG. 9. In place of the controller 46 according to FIGS. 3, 7 and 8, in FIG. 9 a controller unit 74 appears that, in addition to the input for the control variable 44, has an input for the determined toner consumption value 68. From the control variable 44 and the toner consumption value 68, the regulation unit 74 generates a combined manipulating variable 76. The combined manipulating variable 76 is comprised of a first manipulating variable (which is a pure control variable and effects a toner feed) that corresponds to the toner consumption value 68 and a second manipulating variable that is proportioned to the control variable 44 and significantly corresponds to the manipulating variable 48 in the conventional method of FIGS. 3, 7 and 8. In a certain sense, the toner feed is thereby pre-controlled by the determined toner consumption value 68. The second manipulating variable basically serves to compensate errors in the pre-control via regulation.

Given use of the method from FIG. 9, far fewer regulation deviations occur than in the conventional method, i.e. due to the pre-control the control variable 44 (thus the real value of the toner concentration) is relatively close to its desired value.

Since a change of the toner consumption is immediately counteracted by the first manipulating variable, the dynamic behavior of the toner concentration adjustment according to FIG. 9 is far better than in the conventional pure regulation method.

The first manipulating variable is, as indicated, the manipulating variable that the regulation unit 74 would output if the regulation deviation were zero and only a certain toner consumption value signal 68 would be stored in the regulation unit 74. The second manipulating variable is the manipulating variable that the regulation unit 74 would output if only the control variable 44 (i.e. a measurement value of the toner concentration) were fed into the regulation unit 74, however no toner consumption value signal 68 were present at the regulation unit 74. How both of these manipulating variables are combined into one manipulating variable 76 depends on the special design of the regulation unit 74. All regulation units 74 in which the control variable 44 (the measured toner concentration) and the determined toner consumption value 78 are processed into a common manipulating variable 76 fall within the scope of the invention. However, for illustration two simple examples for the regulation unit 74 should be explained in FIGS. 10 and 11 without limitation.

Figure 10:
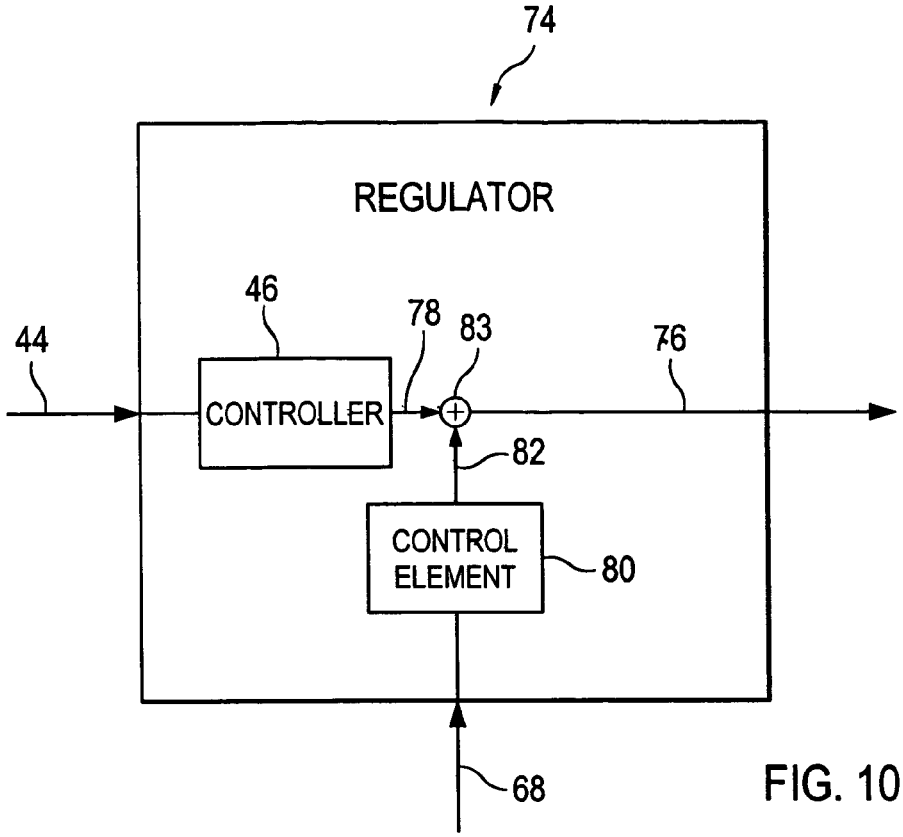
FIG. 10 shows the schematic design of a regulation unit.

An exemplary embodiment for the regulation unit 74 is shown in FIG. 10. The regulation unit 74 comprises a controller 46 of essentially the same type as in FIGS. 2, 3, 7 and 8. The controller 46 receives the control variable 44 as an input signal and outputs the second manipulating variable 78 as an output signal. The controller 74 also comprises a control element 80 that generates the first manipulating variable 82 from the toner consumption value 68. The first manipulating variable 82 and the second manipulating variable 78 are added into the combined manipulating variable 76 at the node point 83.

Figure 11:
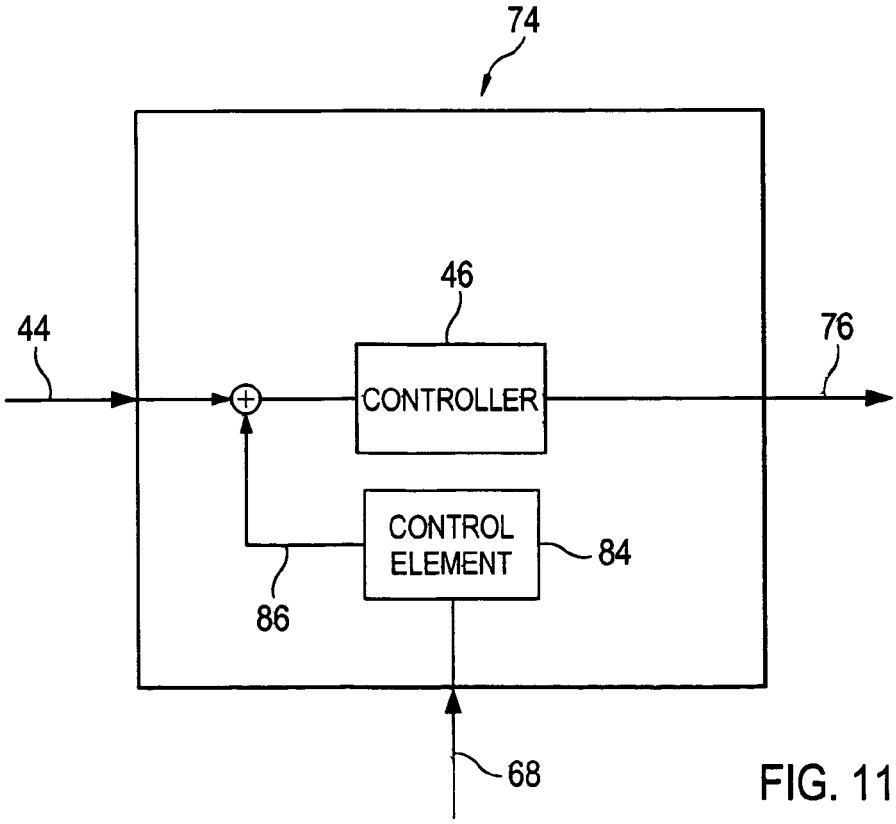
FIG. 11 illustrates the schematic design of a further regulation unit.

In the example of FIG. 11, in addition to the controller 46 the regulation unit 74 comprises a control unit 84 that generates, from the toner consumption value 68, an auxiliary variable that is added to the control variable 44. The auxiliary variable 86 corresponds to that hypothetical regulation deviation from which the controller 46 would predetermine a toner feed corresponding to the toner consumption value 68. What is different than in the exemplary embodiment of FIG. 10 is that the first and second manipulating variables do not explicitly occur in the regulation unit 74 of FIG. 11, however, according to the statements above, are already wholly defined by the present signals, i.e. the toner consumption value 68 or the control variable 44, and are reflected in the combined manipulating variable 76. The term combination of the first and second manipulating variable is to be understood in this broader sense in the framework of the present disclosure.

Figure 12:
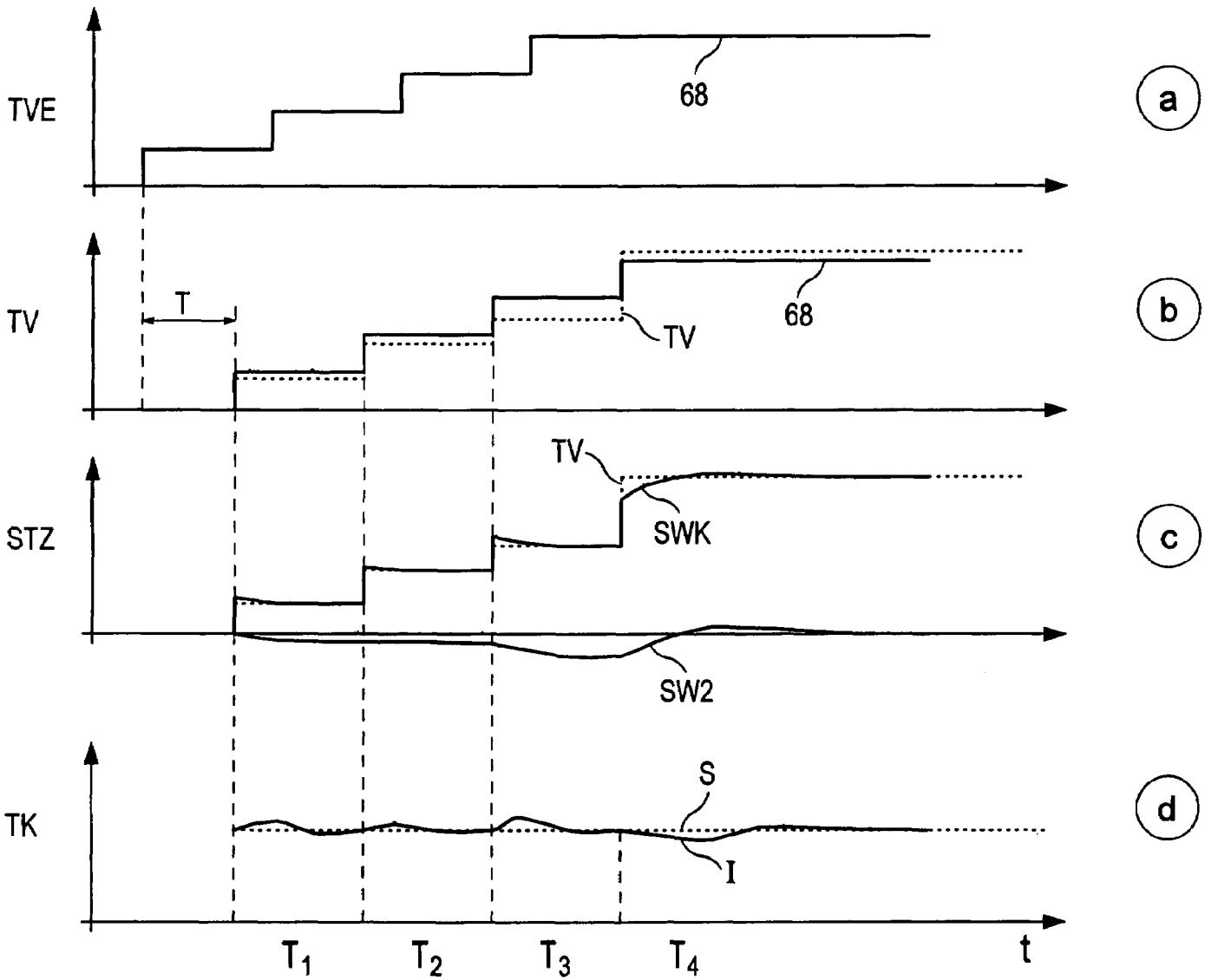
FIG. 12 are four schematic diagrams a-d in which the determined toner consumption value (1), the actual toner consumption (b), the threshold for the toner feed (c) and the toner concentration (d) are plotted against the time.

In FIG. 12, the determined toner consumption value TVE (a), the actual toner consumption TV(b), the control value SW2 of the second manipulating variable or the control value SWK of the combined manipulating variable (c) and the real value I of the toner concentration (d) are plotted against a common time axis in a schematic diagram. The toner consumption value 68 plotted in the diagram (a) has been determined from print data in the print controller 70 of FIGS. 8 and 9. Since the print data exists before the development of the charge image, the determined toner consumption value also respectively exists at a time interval T before the actual toner consumption. The toner consumption value 68 is cached in the delay buffer 72 (see FIGS. 8 and 9) for this time interval T and is thereby synchronized with the actual toner consumption, as shown in diagram (b).

In diagram (b) it is shown that the determined toner consumption value 68 (solid line) deviates somewhat from the actual consumption TV (dotted line). In the time interval $T_1$, for example, the determined toner consumption value 68 lies above the actual consumption TV. The regulation deviation at the beginning of the interval $T_1$ is also equal to 0, as is to be learned from the diagram (d), and the control value SW2 of the second manipulating variable is therefore initially likewise equal to 0 (see diagram c). At the beginning of the time interval $T_1$, the control value SWK of the combined manipulating variable therefore results only from the first manipulating variable and lies, as is to be seen in diagram (c), above the actual consumption because the determined consumption value has been estimated too high. As a consequence of this, the real value of the toner concentration rises above the desired value at the beginning of the interval $T_1$.

In response to this regulation deviation, the regulation unit 74 generates a second manipulating variable with negative control value SW2, which corrects the control value SWK of the combined manipulating variable and approximately adapts to the actual toner consumption TV at the middle of the time interval $T_1$ (see diagram (c)). In the time intervals $T_2$ and $T_3$, in which the determined toner consumption value 68 likewise lies above the actual toner consumption, the same behavior appears.

In the interval $T_4$, the determined toner consumption value 68 lies below the actual toner consumption TV, such that the control value SWK of the combined manipulating variable initially lies below the actual toner consumption TV due to a too-small first manipulating variable. The real value I of the toner concentration TK thereby initially falls below the desired value S, however is regulated back to the desired value S via a then-positive control value SW2 of the second manipulating variable.

From the diagram (c) of FIG. 12 it is clear that the second manipulating variable makes only a relatively small contribution to the combined manipulating variable. It essentially serves to compensate errors in the first manipulating variable due to an imprecise estimate value. Since the first manipulating variable reacts immediately to a determined alteration of the toner consumption value, the dynamic of the method to set the toner concentration is very good. What is different than in a pure control method is that, in the disclosed method, a systematic error in the determination of the toner consumption value is compensated that would otherwise compound in the course of time and would lead to a diverging toner concentration in the developer station 22.

Figure 13:
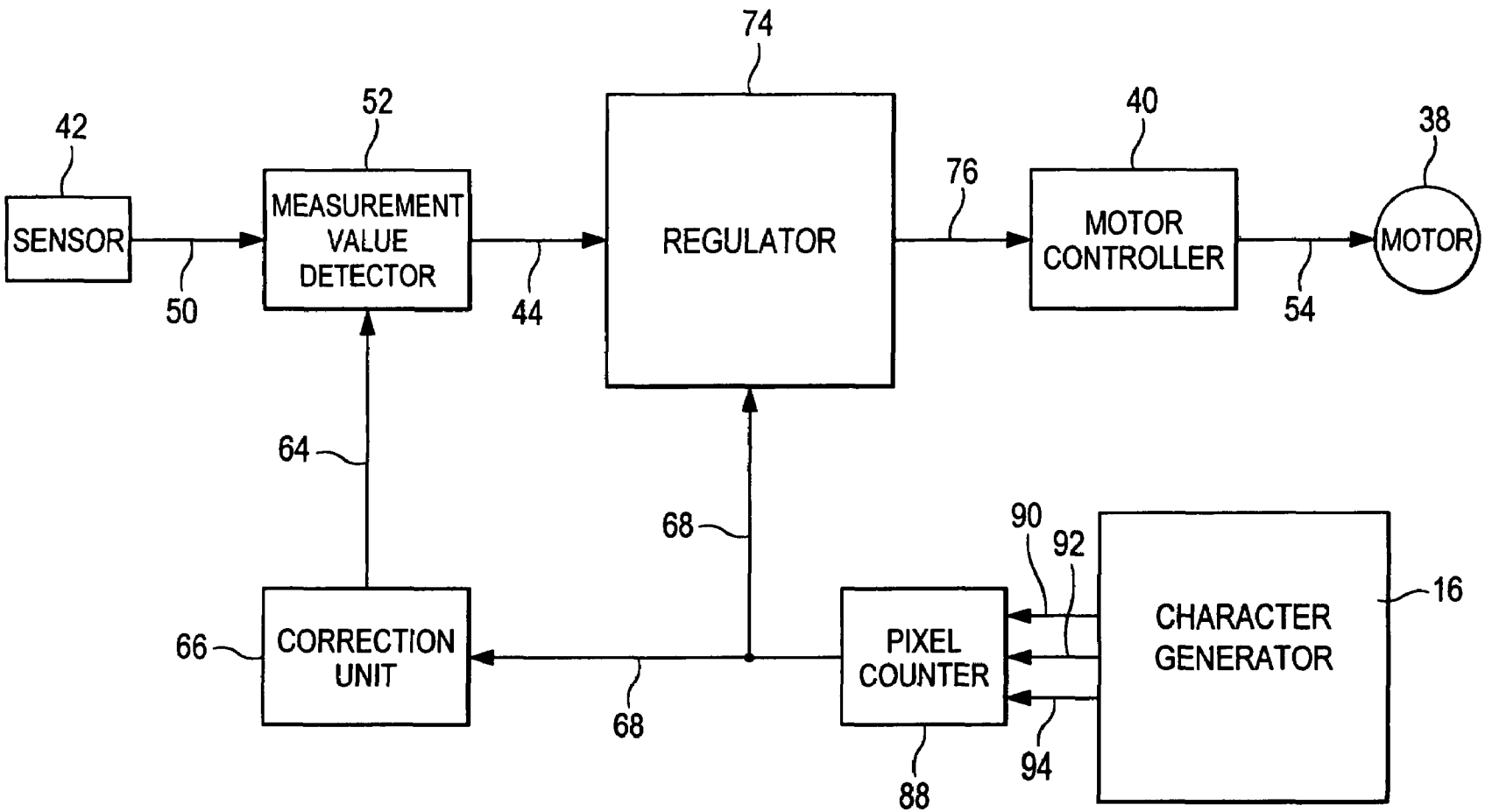
FIGS. 13 through 15 are block diagrams in which developments of the method are schematically shown.

In FIG. 13, an alternative execution of the inventive method is shown that differs from the method of FIG. 9 via the manner according to which the toner consumption value 68 is determined. In the method of FIG. 13 a pixel counter 88 serves for this and which counts the pixels set per inking level in the character generator 16 (see FIG. 1). In the shown exemplary embodiment, the pixel counter 88 is formed by an application-specific integrated circuit (ASIC). The pixel counter 88 has three inputs 90, 92 and 94, corresponding to the three inking levels (light grey, dark grey or, respectively, black) that are considered in the present exemplary embodiment. For each pixel that is set in the character generator 16, a signal is fed into the input 90, 92 or 94 corresponding to the inking level of the pixel. In the pixel counter 88, the toner consumption value 68 is determined from the counted pixels via weighting with their respective inking level, similar to as described above. Such a pixel counter 88 can easily be combined with conventional systems without these having to be significantly modified. The pixel counter 88 can be provided with a delay buffer 72, similar to the print controller 70 of FIG. 8.

Figure 14:
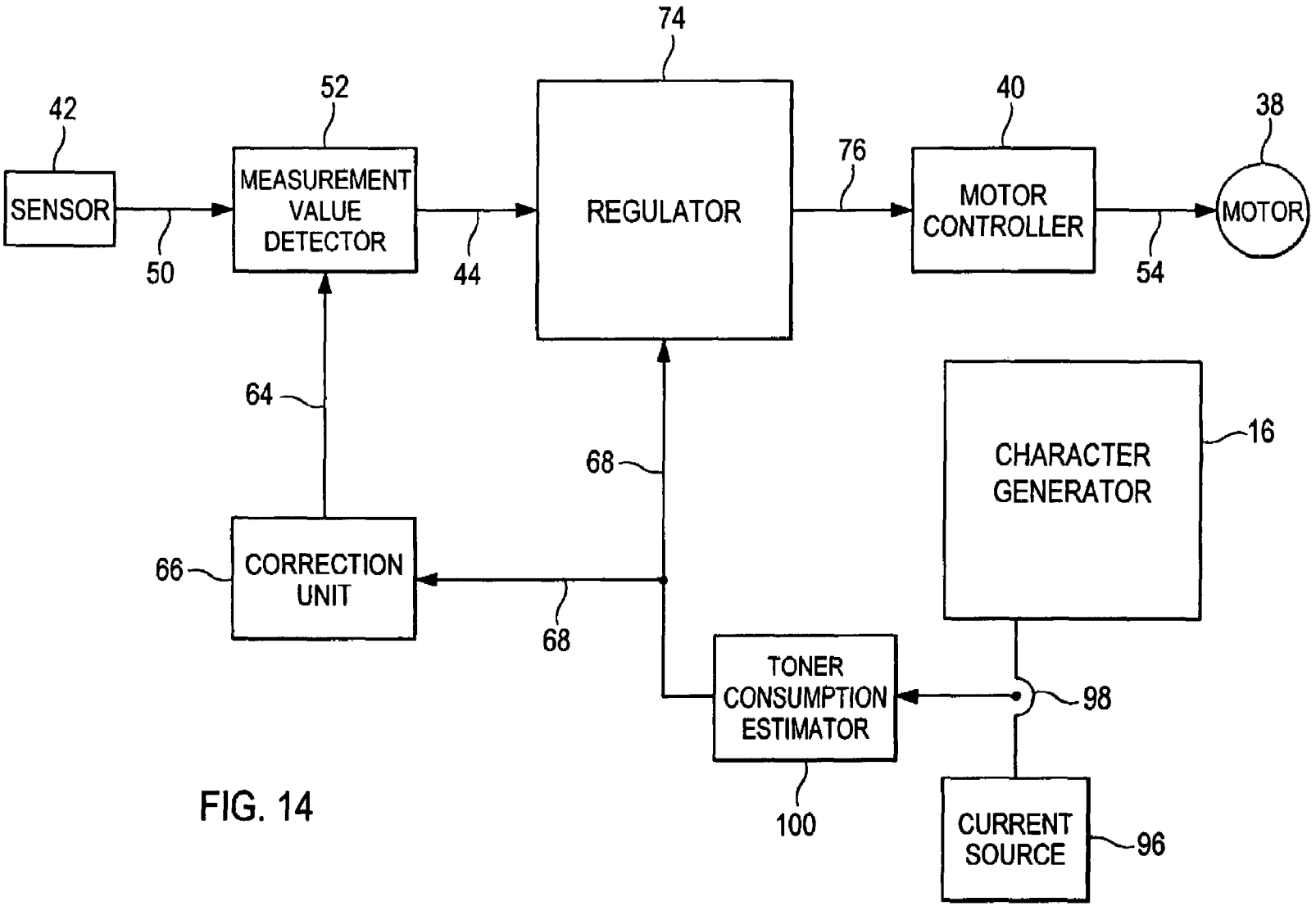

A particularly simple and cost-effectively implementable execution of the method is shown in FIG. 14. The electrical current with which a current source 96 supplies the character generator 16 is thereby measured in a current measurement device 98, and the measurement value is transferred into a toner consumption estimator 100. The toner consumption estimator 100 estimates the toner consumption from the current consumption of the character generator 16. This works because the current consumption of the character generator 16 is, as already explained above, a measure for the number and inking level of the printed pixels. The advantage of the method of FIG. 14 is that it can be implemented in conventional printers or copiers with very slight constructive effort.

Figure 15:
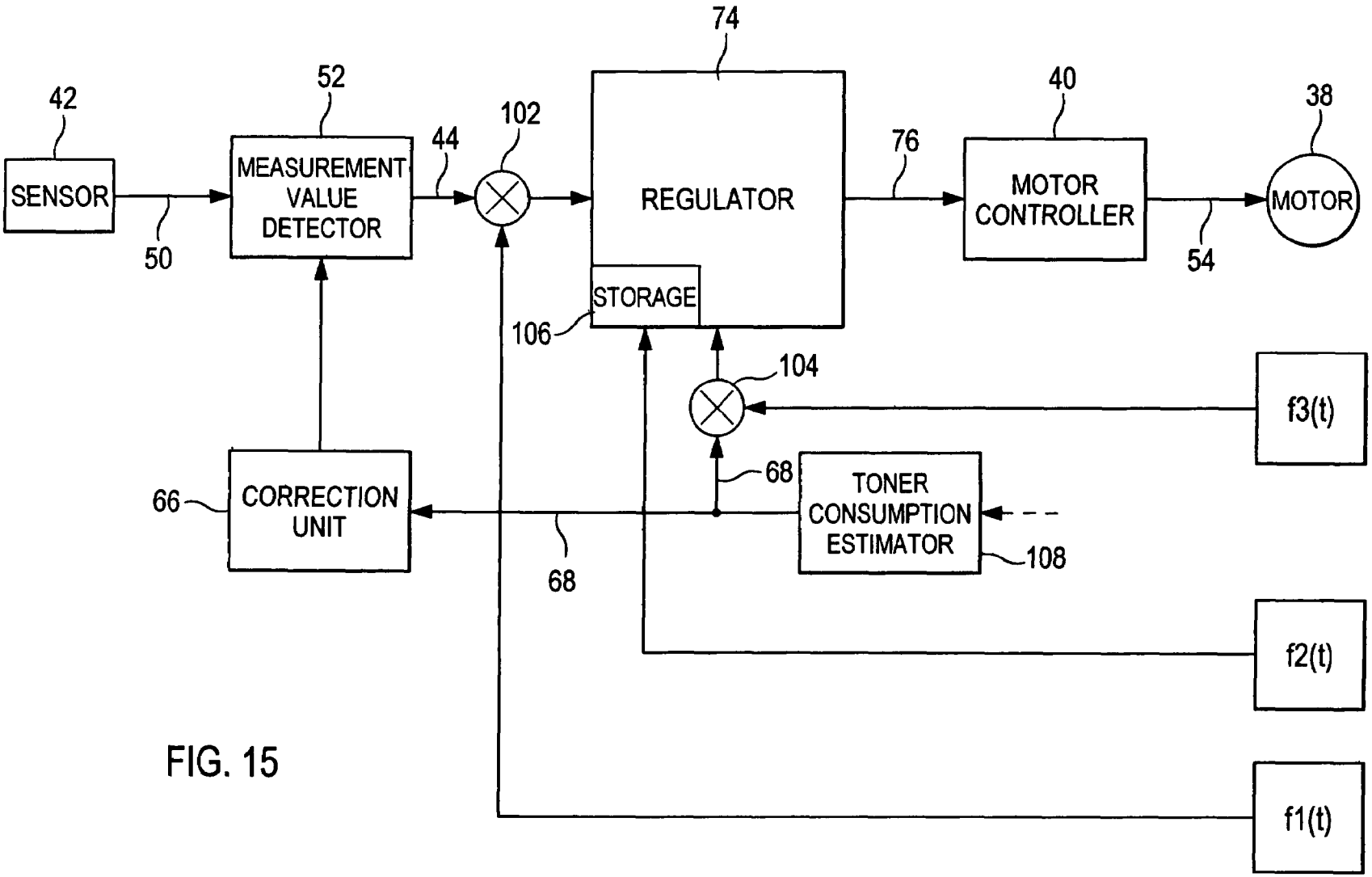

An advantageous development of the method is drawn in a block diagram in FIG. 15. In this method, the contributions of the first and second manipulating variable are temporally varied for the combined manipulating variable 76. Serving for this are a signal weighter 102 that determines the weighting with which the control variable 44 should be considered in the generation of the combined signal 76 and a signal weighter 104 that determines the weighting with which the determined consumption value 68 should be reflected in the combined manipulating variable 76.

The corresponding weighting can be predetermined according to FIG. 15 via time-dependent weighting functions f1($t$) and f3($t$). Thus, for example, the control variable 44 is not very reliable in the start phase of a printer or copier because the mixture flow in the developer station 22 has not yet stabilized. Therefore it is advantageous to keep the contribution of the control variable 44 low for the combined manipulating variable 76, i.e. to keep low the weighting of the second manipulating variable with the aid of the signal weighter 102 and suitable selection of f1($t$) in the start phase, and only to increase it when the state of the mixture in the developer station 22 has stabilized.

Moreover, different regulation parameters for use in the controller 46 are suitable for different temporal sections of the print or copy process or for different states of the printer or copier device such as, for example, warm-up phase, printing phase, calibration phase, freshening of the toner, etc. In the exemplary embodiment of FIG. 15, the regulation unit 74 therefore has a storage 106 in which three regulation parameters are stored, corresponding to a time-dependent or state-dependent function f2($t$).

In the shown exemplary embodiments, the controller 46 is a PID controller; therefore the function f2($t$) is a vector value function whose vector components contain all necessary regulation parameters. In FIG. 15 a toner consumption estimator (not specified in detail) that determines the consumption value 68 is designated with 108. Among other things, the previously described elements printer controller 70, pixel counter 88 or toner consumption estimator 100 are considered as toner consumption estimator 108.

Although preferred exemplary embodiments are shown and described in detail in the drawings and in the preceding specification, these should be viewed as purely exemplary and not as limiting the invention. It is noted that only the preferred exemplary embodiments are shown and specified, and all variations and modifications that presently and in the future lie within the protective scope of the invention should be protected.

The invention claimed is:

1. A method for setting toner concentration of a toner particle-carrier particle mixture in a developer station for development of a latent charge image on an intermediate carrier of an electrographic printer or copier, comprising the steps of:

with a sensor arranged in the developer station, measuring toner concentration in the mixture at an installation location of the sensor remote from a location at which toner is extracted for development of the latent image;

with an actuator adjusting toner feed in the developer station;

determining a current toner consumption value for toner particles and correcting that current toner consumption value to adjust for a difference between the sensor installation location and the toner extraction location;

calculating from the toner concentration measured at said sensor installation location and from the corrected toner consumption value a toner concentration at the toner extraction location; and inputting the calculated toner concentration at the toner extraction location as a control variable to a regulator, and with the regulator controlling the actuator such that the calculated toner concentration at the toner extraction location approaches a desired value.

2. A method according to claim 1 in which the toner consumption value is estimated.

3. A method according to claim 1 in which the actuator is controlled by a combination of a first manipulating variable and a second manipulating variable, whereby the first manipulating variable is proportional to the toner consumption value and the second manipulating variable is proportional to the measured toner concentration.

4. A method according to claim 3 in which the actuator is controlled by a sum of a first manipulating variable and a second manipulating variable, whereby the first manipulating variable is proportional to the toner consumption value and the second manipulating variable is proportional to the measured toner concentration.

5. A method according to claim 3 in which the first manipulating variable is measured such that it effects a toner feed that corresponds to the current toner consumption value.

6. A method according to claim 3 in which the second manipulating variable is measured such that it regulates the toner concentration to a desired value.

7. A method according to claim 3 in which a relative weighting of the first and second manipulating variable is carried out in a course of the print or copy process.

8. A method according to claim 7 in which at least one of the second manipulating variable is suppressed in a start phase of the print or copy process and its weighting is increased when a state of the mixture in the developer station has stabilized.

9. A method according to claim 1 in which the toner feed set at the actuator is based on the toner consumption value.

10. A method according to claim 1 in which the toner consumption value is estimated from print data.

11. A method according to claim 10 in which the toner consumption value is estimated from a number of pixels to be printed, weighted with their inking level.

12. A method according to claim 10 in which the determined toner consumption value is stored in a data buffer until inking of the corresponding print image.

13. A method according to claim 1 in which the toner consumption value is estimated from a number of pixels, weighted with their inking level, that are set in a character generator generating the latent charge image.

14. A method according to claim 13 in which the pixels are counted with aid of an application-specific integrated circuit that is connected with the character generator.

15. A method according to claim 1 in which the toner consumption value is estimated using current consumption of a character generator generating the latent charge image.

16. A method according to claim 1 in which the regulator comprises a PID controller.

17. A method according to claim 1 in which regulator parameters used by the regulator are varied in a course of the print or copy process.

18. A method according to claim 1 wherein said sensor installation location is also remote from a toner in-feed location.

19. A method according to claim 1 wherein said correcting of said current consumption value corrects a toner charge deviating from a desired value since a charged state of the toner is dependent on a toner flow rate based on toner consumption.

20. A device for development of a latent charge image on an intermediate carrier of an electrographic printer or copier device, comprising:

a developer station in which a toner particle-carrier particle mixture is located;

a sensor arranged in the developer station at an installation location of the sensor remote from a location at which toner is extracted for development of the latent image, said sensor measuring a toner concentration in the mixture;

an actuator to set a toner feed in the developer station;

a current toner consumption value indicator for the toner particles, and a correction unit that corrects the current toner consumption value to adjust for a difference between the sensor installation location and the toner extraction location;

a regulator for control of the toner concentration and which controls the actuator dependent on a signal of the sensor and dependent on the corrected toner consumption value, and in the regulator a calculator that calculates from the toner consumption measured at said sensor installation location and from the corrected toner consumption value a toner concentration at said toner extraction location; and the calculated toner concentration at the toner extraction location being input as a control variable into the regulator and the regulator being designed such that it activates the actuator such that the calculated toner concentration at the toner extraction location approaches a desired value.

21. A device according to claim 20 in which the actuator is controlled by a combination of a final manipulating variable and a second manipulating variable, the first manipulating variable being proportional to the toner consumption value and the second manipulating variable being proportional to the measured toner concentration.

22. A device according to claim 21 in which the first manipulating variable is measured such that it affects a toner feed that corresponds to the current toner consumption value.

23. A device according to claim 21 in which the second manipulating variable is measured such that it regulates the toner concentration to a desired value.

24. A device according to claim 20 in which the toner consumption value is estimated from print data.

25. A device according to claim 24 in which the toner consumption value is estimated from a number of pixels to be printed, weighted with their inking level.

26. A device according to claim 20 in which the toner consumption value is estimated from a number of the pixels weighted with their inking level that are set in a character generator generating the latent charge image.

27. A device according to claim 26 wherein an application-specific integrated circuit connected with the character generator counts the pixels.

28. A device according to claim 26 further comprising a current measurement device to measure the current consumption of the character generator generating the latent charge image and an estimator which estimates the toner consumption value using the current consumption of the character generator.

29. A device according to claim 20 wherein said sensor installation location is remote from a toner in-feed location in the developer station.

30. A device according to claim 20 wherein said correction unit corrects for a toner charge deviating from a desired value since a charge state of the toner is dependent on toner flow rate based on toner consumption.

31. A method for setting toner concentration of a toner particle-carrier particle mixture in a developer station for development of a latent charge image on an intermediate carrier of an electrographic printer or copier, comprising the steps of:

with a sensor arranged in the developer station, measuring toner concentration in the mixture;

with an actuator adjusting toner feed in the developer station;

determining a current toner consumption value for toner particles, the value being estimated from print data, and the determined toner consumption value being stored in a data buffer until inking of the corresponding print image;

calculating from the toner concentration measured at an installation point of the sensor and from the toner consumption value a toner concentration at a location in the developer station at which the toner is extracted for development of the latent image; and inputting the calculated toner concentration at the toner extraction location as a control variable in a regulator, and with the regulator activating the actuator such that the calculated toner concentration at the toner extraction location approaches a desired value.

32. A method for setting toner concentration of a toner particle-carrier particle mixture in a developer station for development of a latent charge image on an intermediate carrier of an electrographic printer or copier, comprising the steps of:

with a sensor arranged in the developer station, measuring toner concentration in the mixture;

with an actuator adjusting toner feed in the developer station;

determining a current consumption value for toner particles;

calculating from the toner concentration measured at an installation point of the sensor and from the toner consumption value a toner concentration at a location in the developer station at which the toner is extracted for development of the latent image;

inputting the calculated toner concentration at the toner extraction location as a control variable in a regulator, and with the regulator activating the actuator such that the calculated toner concentration at the toner extraction location approaches a desired value; and the actuator being controlled by a combination of a first manipulating variable and a second manipulating variable, whereby the first manipulating variable is proportional to the toner consumption value and the second manipulating variable is proportional to the measured toner concentration, and wherein a relative weighting of the first and second manipulating variable is carried in a course of the print or copy process.

33. A method according to claim 32 in which at least one of the second manipulating variable is suppressed in a start phase of the print or copy process and its weighting is increased when a state of the mixture in the developer station has stabilized.

* * * * *